US006894590B2

(12) United States Patent
Dove et al.

(10) Patent No.: US 6,894,590 B2
(45) Date of Patent: May 17, 2005

(54) APPARATUS AND METHOD TO INTRODUCE SIGNALS INTO A SHIELDED RF CIRCUIT

(75) Inventors: Lewis R. Dove, Monument, CO (US); Robert E. Alman, Santa Rosa, CA (US); James P. Stephens, Sebastopol, CA (US); Michael T. Powers, Santa Rosa, CA (US); Michael B. Whitener, Santa Rosa, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 41 days.

(21) Appl. No.: 10/449,544

(22) Filed: May 30, 2003

(65) Prior Publication Data

US 2004/0239454 A1 Dec. 2, 2004

(51) Int. Cl.[7] ..... H01P 1/04

(52) U.S. Cl. ..... 333/260; 333/246; 333/33; 29/825

(58) Field of Search ..... 333/33, 34, 246, 333/260; 29/825

(56) References Cited

U.S. PATENT DOCUMENTS

| | | | | |
|---|---|---|---|---|
| 5,404,117 A | * | 4/1995 | Walz | 333/34 |
| 5,508,666 A | * | 4/1996 | Nguyen | 333/33 |
| 5,929,728 A | | 7/1999 | Barnett et al. | 333/239 |
| 6,255,730 B1 | | 7/2001 | Dove et al. | 257/728 |

* cited by examiner

*Primary Examiner*—Stephen E. Jones

(57) ABSTRACT

An interface to a microcircuit formed on a substrate supporting a ground plane. The substrate supports a dielectric structure having gold coated sloped sidewalls electrically connected to the ground plane. A transmission line, connected to the microcircuit, is supported by the dielectric structure. A coaxial cable is connected to the transmission line. The coaxial cable having an end stripped at an angle substantially the same as the sloped side walls of the dielectric structure, wherein the exposed length of the center conductor is bonded to the transmission line, and the outer conductor of the coax cable is bonded to the gold plating on the dielectric structure such that the angled portion of the coax cable mates with the bevel of the thick film dielectric.

21 Claims, 3 Drawing Sheets

APPARATUS AND METHOD TO INTRODUCE SIGNALS INTO A SHIELDED RF CIRCUIT

BACKGROUND OF THE INVENTION

Microwaves are electromagnetic energy waves with very short wavelengths, typically ranging from a millimeter to 30 centimeters peak to peak. In high-speed communications systems, microwaves are used as carrier signals for sending information from point A to point B. Information carried by microwaves is transmitted, received and processed by microwave circuits.

Packaging of RF and microwave microcircuits has traditionally been very expensive. The packaging requirements are extremely demanding—very high electrical isolation and excellent signal integrity through gigahertz frequencies are required. Additionally, IC power densities can be very high. Microwave circuits require high frequency electrical isolation between circuit components and between the circuit itself and the "outside" world (i.e., off the microwave circuit). Traditionally, this isolation was provided by building the circuit on a substrate, placing the circuit inside a metal cavity, and then covering the metal cavity with a metal plate. The metal cavity is typically formed by machining metal plates and connecting multiple plates together with solder or conductive epoxy. The plates can also be cast, which is a cheaper alternative to machined plates. However, one sacrifices accuracy with casting.

One problem attendant with the more traditional method of building microwave circuits is that the method of sealing the metal cover to the cavity uses conductive epoxy. While the epoxy provides a good seal, it comes with a price—high resistance, which increases the loss of resonant cavities and leakage in shielded cavities. Another problem with the traditional method is the fact that significant assembly time is required, thereby increasing manufacture costs.

Another traditional approach to packaging RF/microwave microcircuits has been to attach GaAs or bipolar integrated circuits and passive components to thin film circuits. These circuits are then packaged in the metal cavities discussed above. Direct current feedthrough connectors and RF connectors are then used to connect the module to the outside world.

Another method for fabricating an improved RF microwave circuit is described in U.S. Pat. No. 5,929,728 entitled Imbedded Waveguide Structures for a Microwave Circuit Package, issued on Jul. 27, 1999 to Ron Barnett et al. The '728 patent is incorporated by reference herein for all that it teaches. In general, Barnett teaches a method for fabricating imbedded low-loss waveguide structures in microwave packages via an indented cavity formed in the bottom plane of a metal cover plate. The bottom plane of the cover plate is then fused to a metal base plate. An imbedded shielded cavity is formed when the cover plate and the base plate are joined.

One method for improving RF microwave circuits is to employ a single-layer thick film technology in place of the thin film circuits. While some costs are slightly reduced, the overall costs remain high due to the metallic enclosure and its connectors. Also, dielectric materials typically employed (e.g., pastes or tapes) in this type of configuration are electrically lossy, especially at gigahertz frequencies. The dielectric constant is poorly controlled at both any specific frequency and as a function of frequency. Also, controlling the thickness of the dielectric material often proves difficult.

An improvement upon such methods for fabricating RF microwave circuits is described in U.S. Pat. No. 6,255,730, incorporated herein by reference, entitled Integrated Low Cost Thick Film RF Module naming Lewis R. Dove (co-inventor of the present invention), John F. Casey and Anthony R. Blume as inventors. The '730 patent is assigned to Agilent Technologies, Inc., which is also the assignee of the present invention. The '730 patent describes an integrated low cost thick film RF and microwave microcircuit module. Using an improved thick film dielectric, inexpensive, three-dimensional structures are fabricated on top of a conductive ground plane which is applied to a base substrate. The ground plane forms the bottom electrical shield for the module. A bottom layer of dielectric can be employed to form both microstrip elements and the bottom dielectric for stripline elements. Using an etchable thick film Au process, very small and tightly controlled geometries can be patterned.

Once a shielded RF circuit has been formed, a new challenge opens up, how to introduce signals into the circuit. One option is to use microwave connectors. Microwave connectors provide a very low return loss and low insertion loss and are often used to bring high frequency or high-speed digital signals from the outside world into a microcircuit. However, they are relatively expensive and take up a large amount of space. This becomes a serious problem with circuits requiring many high-frequency connections.

Another possible solution is to attach the center conductor of a semi-rigid coxial line to a microcircuit or circuit board transmission line. However, this exposes the coax line to the edge of a board or substrate, which could couple electromagnetic energy from the coax into the substrate (as a quasi-waveguide mode) rather than to the circuit's transmission line.

Accordingly, the present inventors have recognized a need for method and apparatus to introduce signals into a shielded RF circuit without large interconnects and without coupling electromagnetic energy into the substrate of the RF circuit.

BRIEF DESCRIPTION OF THE DRAWINGS

An understanding of the present invention can be gained from the following detailed description of the invention, taken in conjunction with the accompanying drawings of which.

DETAILED DESCRIPTION

Figure 1B:
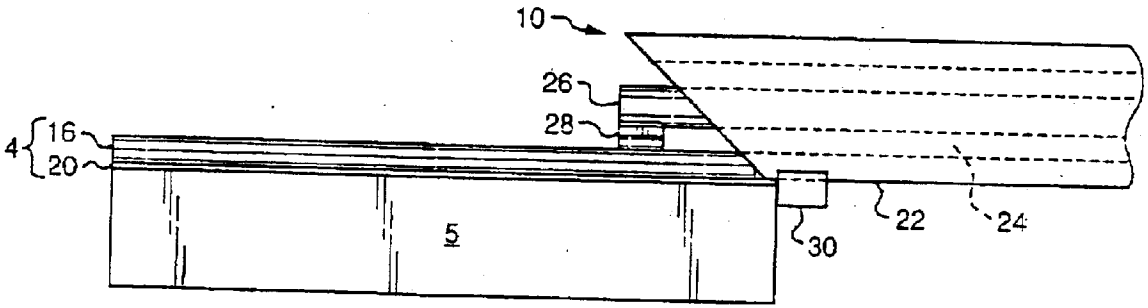
FIG. 1B is a side view of a coaxial cable connected to a transmission line in accordance with the first preferred embodiment of the present invention.

Reference will now be made in detail to the present invention, examples of which are illustrated in the accompanying drawings, wherein like reference numerals refer to like elements throughout.

Figure 1A:
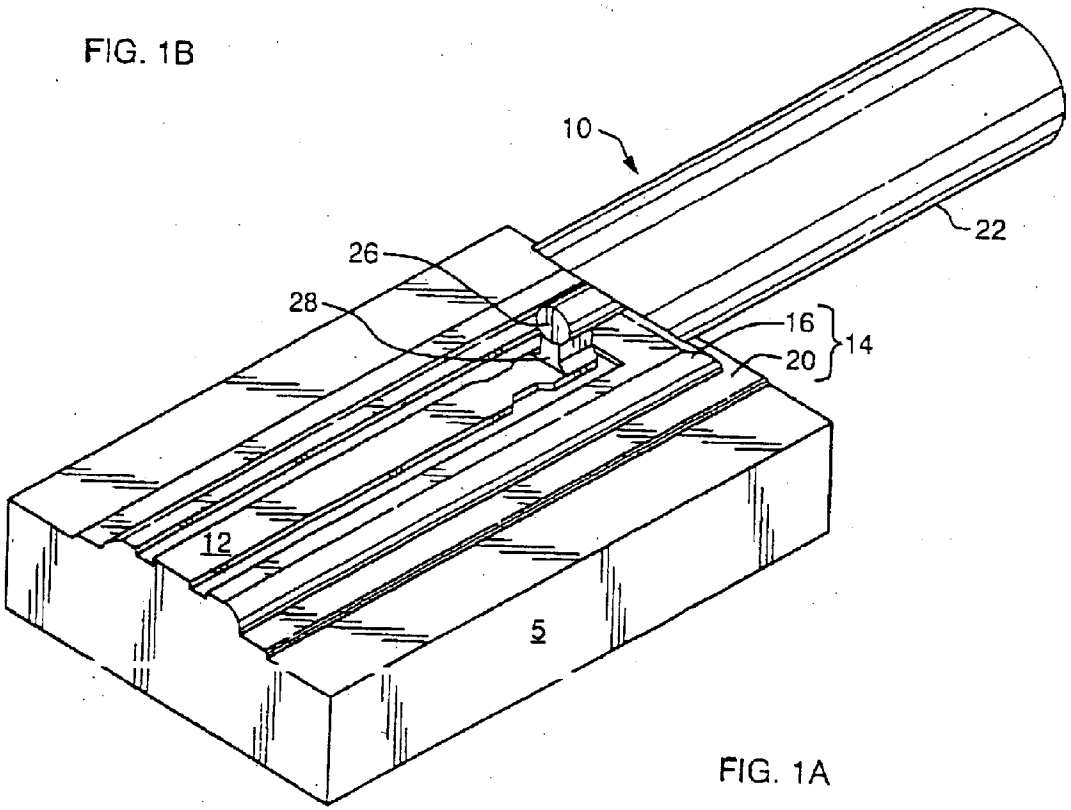
FIG. 1A is an isometric diagram of a coaxial cable connected to a transmission line in accordance with a first preferred embodiment of the present invention.

FIG. 1A is an isometric diagram of a coaxial cable 10 connected to a transmission line 12 in accordance with a preferred embodiment of the present invention. FIG. 1B is a side view of the coaxial cable 10 connected to the transmission line 12 in accordance with the first preferred embodiment of the present invention. Collectively, FIGS. 1A and 1B show the connection of a coaxial cable 10 to a transmission line 12 situated atop a dielectric structure 14. The dielectric structure is preferably formed on a substrate 5 that includes a ground plane. The transmission line 12, in the illustrated example, is a microstrip that preferably transitions into a quasi-grounded coplanar waveguide (not shown). The transmission line 12 is an example of an open transmission line. Open transmission line may be of a variety of structures, including: microstrip, coplanar waveguide, and coupled microstrip. Once the transition from the coaxial cable to an open transmission line has been made additional geometries may be introduced including: stripline, quasi-coaxial, and coupled stripline. It may also be preferable for the coaxial cable 10 to directly interface with such other transmission line structures, including a quasi-coaxial transmission line.

A quasi-coaxial transmission line uses an upper layer of KQ dielectric printed over the transmission line. The KQ dielectric is surrounded by a printed metal ground plane providing a completely surrounded structure. For high frequency or high-speed digital signals, it may be beneficial for the transmission line 12 to exhibit a 50Ω impedance.

The dielectric structure 14 may be formed from a thick film paste that is applied and subsequently cured. Examples of suitable thick film dielectric materials that may be deposited as a paste and subsequently cured include the KQ 150 and KQ 115 thick film dielectrics from Heraeus and the 4141A/D thick film compositions from DuPont. These materials are primarily formulations of borosilicate glass containing small amounts of aluminum and magnesium. These products are applied as a paste, typically through a screen or stencil, and subsequently cured by the application of heat. They may be patterned at the time of application, before curing, or after curing by known techniques (e.g., laser etching). These processes are described in data sheets from the respective manufacturers. While the end result of using any of these products is essentially the same (a patterned region of controlled thickness and having a dielectric constant K of about 3.9) they have various ancillary differences that may be of interest to the designer. These include a change of color when cured, and an upward shift in softening temperature after an initial cure to facilitate structural stability during subsequent processing steps that require the re-application of heat to produce curing or processing of materials applied in those subsequent processing steps.

While the dielectric structure 14 may be formed of a single layer of KQ, in the example shown in FIG. 1, the dielectric structure 14 is formed of two layers 16 and 20. The number of layers is a function of the maximum thickness of the process used to create each layer and the desired height of the dielectric structure 14. The diameter of the coaxial cable 10 may factor into the determination of the height of the dielectric structure 14, especially if the substrate 5 is to be used to support the coaxial cable 10. Generally, desirable coaxial cables will have a diameter of 1.2 ~1.8 mm, however cables of other dimensions may be utilized in accordance with the present invention. Therefore, the height of the dielectric structure 14 will be around 0.4 ~0.6 mm. One interesting property of KQ type materials is that the free edges of the material pulls back during firing. This action creates a roughly 45-degree bevel around the dielectric structure 14.

In accordance with the preferred embodiments of the present invention, the beveled edges of the dielectric structure 14 are coated with gold thereby extending the ground plane up the beveled slopes of the dielectric structure 14. As an aside, the side grounds around the center conductor of the waveguide (the transmission line 12) are formed by the grounded sidewalls of the dielectric structure 14.

The coaxial cable 10 used as an example in FIGS. 1A and 1B is based on a low loss phase stable semi-rigid coax cable such as UT 47-LL and UT 70-LL available from MICRO-COAX COMPONENTS INC. The coaxial cable 10 comprises an outer conductor 22, a dielectric layer 24 and a center conductor 26. The outer conductor 22 may be formed of copper, the dielectric layer 24 of PTE, while the center conductor 26 is silver-plated copper. The outer conductor 22 may be tin plated to provide additional durability. To prepare the coaxial cable 10 for connection to the transmission line 12 and ground plane, the outer conductor 22 and dielectric layer 24 are stripped at an angle to the axis of the coaxial cable 10 substantially matching the bevel on the edge of the dielectric structure 14. In the example given above, this angle is approximately 45 degrees. The exposed face of the center conductor 26 is preferably left square to the axis of the coaxial cable 10. While those of ordinary skill in the art will recognize the importance of modeling the connection to precisely determine the optimum length of the expose coaxial cable 10, it is understood that shorter is better, probably in the neighborhood of 10mil as measured at the longest point.

The coaxial cable 10 can be connected to the transmission line 12 and the ground plane using a variety of techniques including conductive epoxy or solder. If solder is chosen for the connection, the solder should be of a type that limits or eliminates leaching of the gold layer on the dielectric structure 14. The center conductor 26 may be supported by a pedestal 28 fixed with solder or epoxy between the transmission line 12 and the center conductor 26. The portion of the outer conductor 22 contacting the bevel of the dielectric structure 14 is fixed with solder or epoxy to provide adhesion. It may prove easier and more cost effective to simply apply the solder or epoxy to the entire area where the coaxial cable 10 aligns with the bevel of the dielectric structure 14. An optional support 30 may be provided if necessary. If desired the support can be gold plated and electrically connected to the ground plane and the outer conductor 22. It is also to be noted that a support may be simply solder adhering the coaxial cable 10 to the substrate 5.

Beveling the coaxial cable 10 to match the natural slope of the dielectric structure 14 minimizes the high-frequency discontinuity between the two and makes it relatively easy to connect the outer conductor 22 to the sidewall of the dielectric structure 14 and hence to the ground plane. Electromagnetic simulations show significant improvement in the quality of the connection. The thickness of the dielectric structure 14 can be adjusted to match the height of the center conductor 26. The coaxial cable 10 can rest on the substrate 5 and/or a support 30 associated with the substrate 5, providing mechanical rigidity for the coaxial cable 10 and a way to connect the coaxial cable's outer conductor 22 to the ground of the circuit. The connection illustrated in FIG. 1 optimizes the microwave performance of the connection.

Figure 2B:
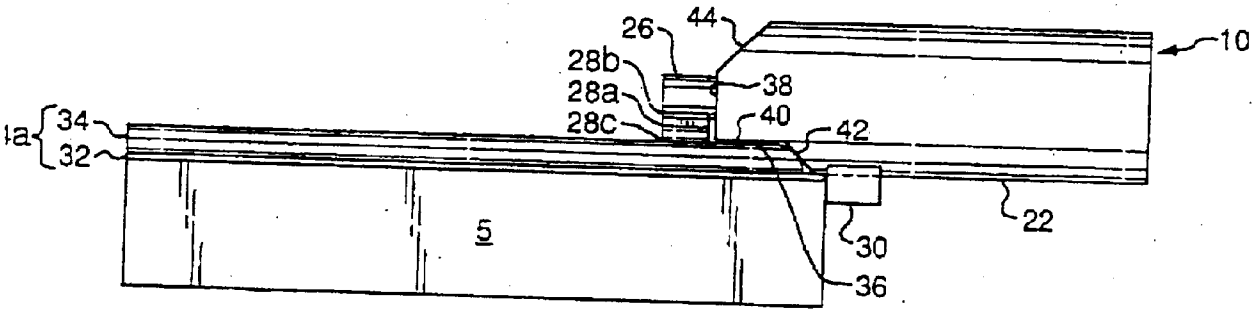
FIG. 2B is a side view of a coaxial cable connected to a transmission line in accordance with the second preferred embodiment of the present invention.
Figure 2A:
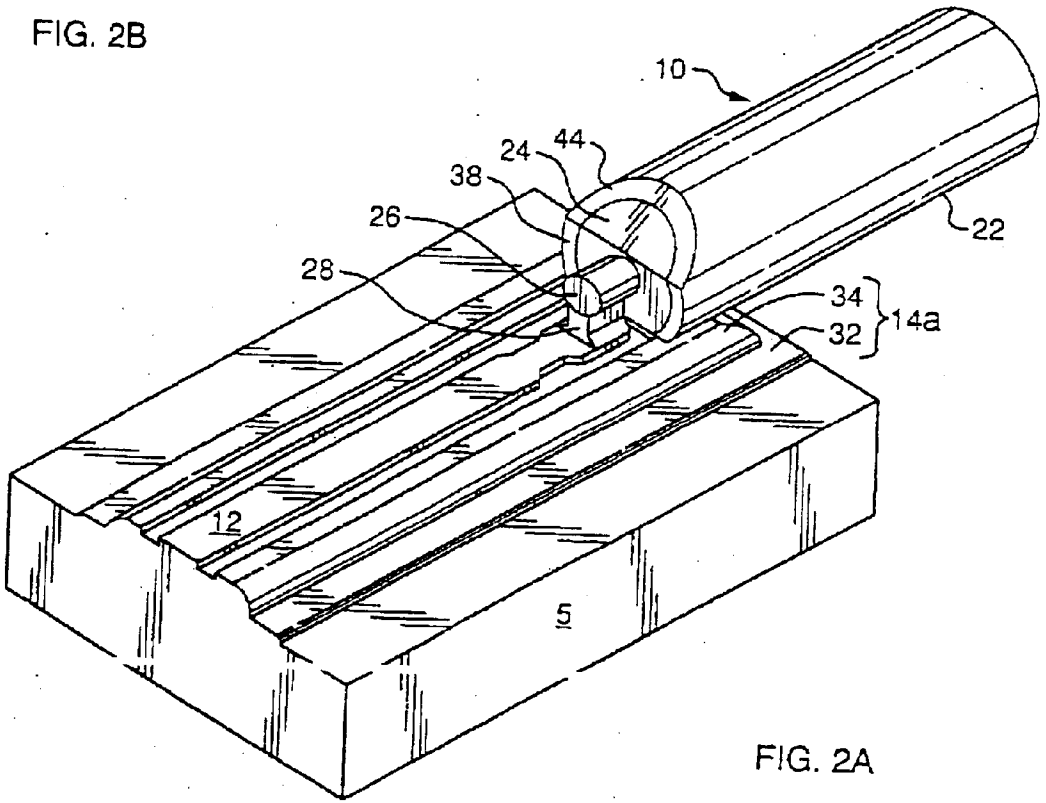
FIG. 2A is an isometric diagram of a coaxial cable connected to a transmission line in accordance with a second preferred embodiment of the present invention.

FIG. 2A is an isometric diagram of a coaxial cable 10 connected to a transmission line 12 in accordance with a second preferred embodiment of the present invention. FIG. 2B is a side view of a coaxial cable 10 connected to a transmission line 12 in accordance with the second preferred embodiment of the present invention. The dielectric structure 14*a* is formed of two layers 34 and 32. As noted above, the number and thickness of such layers 34 and 32 are determined by the process used to form the dielectric structure 14*a* and may take into account the thickness of the coaxial cable 10. In accordance with the second preferred embodiment, the coaxial cable 10 has been stripped in an alternative fashion to potentially improve signal integrity over the embodiment shown in FIGS. 1*a* and 1*b*.

Additional details of the pedestal 28 can be seen in FIG. 2B. In this example, the pedestal 28 is using a shim 28*a* that secures the center conductor 26 to the transmission line 12 by solder, seen at 28*b* and 28*c*. It may prove easier to simply flow solder around the entire shim 28*a* to form the connection. As with the example shown in FIG. 1, the height of the pedestal 28 is selected based on the elevation of the center conductor 26 above the transmission line 12.

It has been determined that it is advantageous to minimize the distance between the connection point of the center conductor 26 on the transmission line 12 and the connection point of the outer conductor 22 on the dielectric structure 14*a*. A separation on the order of a 5 mils provides superior results while being technically feasible. However, should increased cost be bearable, smaller gaps may provide additional benefits, as always modeling is advised. Accordingly, adhering at least some of the outer conductor 22 to the upper surface of the dielectric structure 14*a* in region 36 facilitates closer control over the subject distance. It is desirable, but not necessary, that there be no more than 1 mil separation between the dielectric structure 14*a* and the outer conductor 22.

For example, at least one conductive strip may be formed on the region 36 on the surface of the layer 34 of the dielectric structure 14*a*. Gold deposits can form the strip 36. The strip is electrically connected to the gold layer deposited on the bevels of the dielectric structure 14*a*. The size and shape of the strip is preferably determined via modeling of the connection.

The coaxial cable 10 is initially striped to expose the center conductor 26 leaving a flat surface 38 perpendicular to the longitudinal axis of the coaxial cable 10. In the particular example depicted, the center conductor 26 preferable protrudes around 10 –14 mil past the flat surface 38. However, it is cautioned that the exact distance for any given connection should be determined through modeling and/or empirical analysis.

A portion 40 of the outer conductor 10 and the dielectric layer 24 is cut parallel to the longitudinal axis of the coaxial cable 10. The portion 40 is fixed to the surface of the dielectric layer 14*a*. As noted, the exposed portions the outer conductor 22 may be electrically connected to a conductive strip deposited in region 36, e.g. using solder or epoxy. A portion 42 of the outer conductor 10 and the dielectric layer 24 is cut to substantially match the natural angle of the dielectric structure 14*a* and is electrically connected to the gold plating on the bevel of the dielectric structure 14*a*.

The present inventors have discovered that a secondary bevel 44, opposite the portions 40 and 42, may improve the response of the connection. In the example shown in FIG. 2, the bevel 44 extends from the outer surface of the center conductor 26 at an angle of approximately 45 degrees. However, it is cautioned that the exact angle and starting location for any given coaxial cable 10 and connection should be determined through modeling and/or empirical analysis.

As in the first embodiment, the center conductor 26 is supported by a shim 28 that may be, for example, soldered into place. Also the coaxial cable 10 may be supported by a support 30 associated with the substrate.

Figure 3:
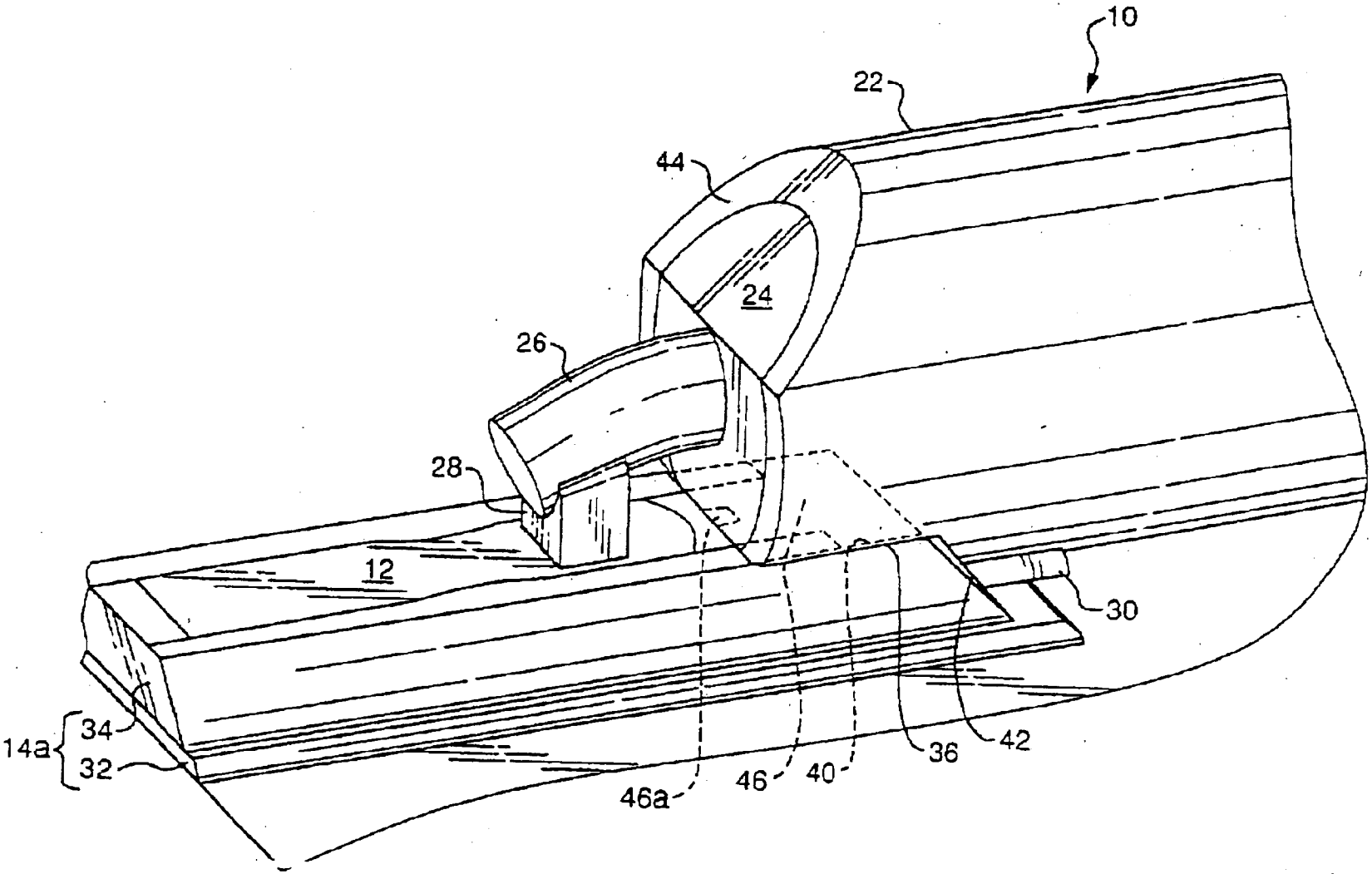
FIG. 3 is an isometric wireframe diagram of a coaxial cable connected to a transmission line in accordance with a third preferred embodiment of the present invention.

FIG. 3 is a diagram of a coaxial cable 10 connected to a transmission line 12 in accordance with a third preferred embodiment of the present invention. The present inventors have discovered that it not only desirable to reduce the distance between the connection points of the center conductor 26 and the outer conductor 22, but it may also prove beneficial to reduce the distance between the center conductor 26 and the transmission line 12. To that end, and in accordance with the third embodiment of the present invention, the center conductor 26 is bent toward the transmission line 12 to reduce the distance between the center conductor 26 and the transmission line 12 to approximately 3 mils. The coaxial cable 10 is stripped such that the furthest tip of the center conductor 26 is approximately 20-30 mils from the flat surface 38.

In the example shown in FIG. 3, a strip 46 is shown deposited in the region 36, a notch 46*a* is formed in the strip to control the area of the strip 46 to provide reduce capacitance to ground to provide superior electrical performance. Those of ordinary skill in the art will be able to model each particular connection to determine the optimum area of the strip 46.

Although several embodiments of the present invention has been shown and described, it will be appreciated by those skilled in the art that changes may be made in these embodiments without departing from the principles and spirit of the invention, the scope of which is defined in the claims and their equivalents.

What is claimed is:

1. An interface to a microcircuit comprising:

a substrate supporting a ground plane;

a dielectric structure having gold coated sloped side walls electrically connected to the ground plane;

a transmission line supported by the dielectric structure, the transmission line being in electrical communication with the microcircuit; and a coaxial cable having at least a first portion of an end beveled at an angle substantially the same as the angle of the sloped side walls of the dielectric structure, wherein:

the exposed length of the center conductor is bonded to the transmission line; and the outer conductor of the coax cable is bonded to the gold plating on the dielectric structure such that the angled portion of the coax cable mates with the bevel of the thick film dielectric.

2. An interface, as set forth in claim 1, further comprising a shim connecting the exposed length of the center conductor to the transmission line.

3. An interface, as set forth in claim 1, wherein the exposed length of the center conductor is bent toward the transmission line.

4. An interface, as set forth in claim 1, wherein the coaxial cable has a second beveled portion, opposite the first portion, the second beveled portion sloping in a different direction than the first beveled portion.

5. An interface, as set forth in claim 1, wherein the first portion is adjacent a flat portion having a surface extending co planer with the center conductor, the flat portion traversing between the first portion and the face of the coaxial cable from which the center conductor extends.

6. An interface, as set forth in claim 5, wherein the flat portion is supported by the top surface of the dielectric structure.

7. An interface, as set forth in claim 6, wherein the dielectric structure has electrical traces connected to the gold coated sloped side walls, the electrical traces being situated under the flat portion of the coaxial cable such that an electrical connection is formed between exposed edges of the outer conductor and the electrical traces.

8. An interface, as set forth in claim 7, wherein a gap between the electrical traces and the transmission line is 10 mil or less.

9. An interface, as set forth in claim 1, wherein the transmission line is one of microstrip, coplanar waveguide, and coupled microstrip.

10. An interface, as set forth in claim 1, wherein the transmission line interfaces with a second transmission line structure including: stripline, quasi-coaxial, and coupled stripline.

11. A method of connecting a coax cable to a transmission line situated on top of at least one layer of thick film dielectric in an integrally shielded microcircuit, the method comprising:

exposing a length of the center conductor of the coax cable;

stripping a portion of the coax cable at an angle substantially the same as a bevel on at least one layer of thick film dielectric;

gold plating the bevels of the at least one layer of thick film dielectric;

bonding the exposed length of the center conductor to the transmission line; and bonding an outer conductor of the coax cable to the gold plating on the at least one layer of thick film dielectric such that the angled portion of the coax cable mates with the bevel of the thick film dielectric.

12. The method as set forth in claim 11, wherein the transmission line is one of microstrip, coplanar waveguide, and coupled microstrip.

13. The method, as set forth in claim 11, wherein the transmission line interfaces with a second transmission line structure including: stripline, quasi-coaxial, and coupled stripline.

14. The method, as set forth in claim 11, wherein the thick film dielectric is a KQ material.

15. The method, as set forth in claim 11, further comprising:

beveling a portion of the coaxial cable opposite the angled portion.

16. The method, as set forth in claim 11, further wherein the step of bonding the exposed length of the center conductor to the transmission line comprises:

bonding a shim to the transmission line; and bonding the center conductor to the shim.

17. The method, as set forth in claim 11, further comprising:

bending the exposed length of the center conductor to the transmission line toward the angled portion of the of the stripped coaxial cable.

18. The method, as set forth in claim 11, further comprising:

cutting a flat portion in the coaxial cable adjacent the angled portion to mate with the top of the thick film dielectric.

19. The method, as set forth in claim 18, further comprising:

coating a portion of the top of the thick film dielectric with gold; and bonding the outer conductor on the flat portion of the coaxial cable to the gold coating on the top of the thick film dielectric.

20. The method, as set forth in claim 19, wherein a gap between portion of the transmission line to which the center conductor is bonded and the gold plating is 10 mil or less.

21. The method, as set forth in claim 11, wherein a gap between portion of the transmission line to which the center conductor is bonded and the gold plating is 10 mil or less.

* * * * *